US007369125B2

(12) United States Patent
Tokioka et al.

(10) Patent No.: US 7,369,125 B2
(45) Date of Patent: May 6, 2008

(54) CURRENT SUPPLY CIRCUIT AND DISPLAY DEVICE HAVING THE CURRENT SUPPLY CIRCUIT

(75) Inventors: Hidetada Tokioka, Hyogo (JP); Masafumi Agari, Hyogo (JP); Ryuichi Hashido, Hyogo (JP); Masashi Okabe, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 332 days.

(21) Appl. No.: 10/529,175

(22) PCT Filed: May 20, 2004

(86) PCT No.: PCT/JP2004/007244

§ 371 (c)(1),
(2), (4) Date: Mar. 23, 2005

(87) PCT Pub. No.: WO2004/107303

PCT Pub. Date: Dec. 9, 2004

(65) Prior Publication Data

US 2006/0038800 A1 Feb. 23, 2006

(30) Foreign Application Priority Data

May 28, 2003 (JP) ..... 2003-151021

(51) Int. Cl.
*G09G 5/00* (2006.01)

(52) U.S. Cl. ..... 345/211; 345/76

(58) Field of Classification Search ..... 345/211, 345/212, 76

See application file for complete search history.

(56) References Cited

U.S. PATENT DOCUMENTS

| | | | | |
|---|---|---|---|---|
| 5,959,600 | A | 9/1999 | Uchino et al. | |
| 6,229,508 | B1 | 5/2001 | Kane | |
| 6,307,681 | B1 | 10/2001 | Aoki et al. | |
| 6,332,661 | B1 | 12/2001 | Yamaguchi | |
| 6,501,226 | B2 * | 12/2002 | Lai et al. | 315/169.1 |
| 2002/0024054 | A1 * | 2/2002 | Koyama et al. | 257/84 |
| 2002/0067328 | A1 | 6/2002 | Yumoto et al. | |
| 2003/0030602 | A1 * | 2/2003 | Kasai | 345/76 |
| 2003/0122745 | A1 * | 7/2003 | Miyazawa | 345/76 |
| 2004/0080473 | A1 * | 4/2004 | Higuma et al. | 345/76 |
| 2004/0100430 | A1 * | 5/2004 | Fruehauf | 345/82 |
| 2004/0201554 | A1 * | 10/2004 | Satoh | 345/76 |

FOREIGN PATENT DOCUMENTS

| | | |
|---|---|---|
| JP | 11-212493 | 8/1999 |
| JP | 11-311804 | 11/1999 |

(Continued)

*Primary Examiner*—Bipin Shalwala
*Assistant Examiner*—Afroza Y Chowdhury
(74) *Attorney, Agent, or Firm*—Leydig, Voit & Mayer, Ltd.

(57) ABSTRACT

A current supply circuit providing a data line with a current corresponding to a digital signal composed of data bits includes a current control circuit, a precharge switch and a precharge regulating circuit. The current control circuit responds to control signals reflecting respective data bits to control the amount of current along the data line. The precharge switch precharges the data line to a predetermined voltage prior to current supply. The precharge regulating circuit exchanges with the data line electric charge corresponding to the control signals to move the voltage on the data line closer to a steady voltage corresponding to the data bits. In this way, an analog current corresponding to digital data can be promptly produced.

10 Claims, 8 Drawing Sheets

FOREIGN PATENT DOCUMENTS

| | | |
|---|---|---|
| JP | 2001-296837 | 10/2001 |
| JP | 2003-114644 | 4/2003 |
| JP | 2003-150104 | 5/2003 |
| JP | 2004-117921 | 4/2004 |

* cited by examiner

CURRENT SUPPLY CIRCUIT AND DISPLAY DEVICE HAVING THE CURRENT SUPPLY CIRCUIT

TECHNICAL FIELD

The present invention relates to a current supply circuit, and more particularly, to a current supply circuit providing an analog current corresponding to digital data, and a display device in which each pixel includes a current-driven light-emitting device such as an organic electroluminescent (EL) device having varying emission brightnesses depending on an electric current, thereby performing gray-scale display using a current provided by the current supply circuit.

BACKGROUND ART

In the field of flat panel displays, self-emitting display devices with each pixel composed of a current-driven light-emitting device are gaining in popularity. A self-emitting display device features good visibility as well as excellent dynamic imaging characteristics. Among the current-driven light-emitting devices, light-emitting diodes (LEDs) are particularly well known.

Generally, a display device has a plurality of pixels arranged in a matrix, which are successively driven using dot-sequential or line-sequential scanning and are supplied with a display current. They provide a brightness corresponding to the display current supplied during the driving until they are driven next time. The display current received by the pixels is typically an analog current to achieve gray-scale display. The analog current is set at levels between the maximum and minimum brightnesses for each emitting device such that it can provide gray-scale display.

Thus, a display device including a current-driven light-emitting device requires a current supply circuit that accurately generates a display current corresponding to image data indicating brightness in gray-level for each pixel. In general, image data is digital data with a plurality of bits.

A current supply circuit in such a display device for supplying a display current for gray-scale display (hereinafter also referred to as "gray-scale current") is disclosed in, for example, Japanese Patent Laying-Open No. 11-212493 (hereinafter referred to as "conventional art"), FIG. 1. A current supply circuit according to the conventional art uses thin film transistors (TFTs) which are selectively turned on/off in response to a plurality of bits composing image data to connect a plurality of constant-current supplies in parallel to generate a gray-scale current, which is the sum of supply currents from these constant-current supplies.

DISCLOSURE OF THE INVENTION

However, in a current supply circuit configured according to the conventional art, the steady voltage on the output node on which the output currents from these constant-current supplies are added up varies corresponding to the level of the gray-scale current to be supplied, depending on the characteristics of the current driving devices in the constant-current supplies. Thus, during the supply of a gray-scale current corresponding to image data, the gray-scale current does not settle at a level corresponding to image data in the transient period i.e. until the output node reaches a steady voltage that corresponds to the gray-scale current. As a result, a current supply circuit with such a configuration has difficulty in promptly generating an accurate gray-scale current for gray-scale display.

The present invention attempts to solve the problem as stated above. An object of the present invention is to provide a current supply circuit capable of promptly supplying an analog current corresponding to digital data, and an arrangement of a display device supplying a gray-scale current using such a current supply circuit.

A current supply circuit according to the present invention is a current supply circuit providing an output current corresponding to digital data of n bits (n is an integer not less than 2), including: a current output node electrically connected with a first power supply node via a current driving device during current supply; a current control circuit provided between a second power supply node and the current output node and receiving the digital data for controlling, corresponding to the digital data, an amount of current on a current path established including the current output node between the first and second power supply nodes during the power supply; and a voltage regulating circuit receiving the digital data for forcing, after the current supply starts, a change in voltage on the current output node based on the digital data.

A current supply circuit according to another arrangement of the present invention is a current supply circuit providing an output current corresponding to digital data of n bits (n is an integer not less than 2), including: a current output node electrically connected to a first power supply node via a current driving device during current supply; a current control circuit provided between a second power supply node and the current output node and receiving the digital data for controlling, corresponding to the digital data, an amount of current on a current path established including the current output node between the first and second power supply nodes during the current supply; and a current regulating circuit receiving the digital data for moving, prior to the current supply, a voltage on the current output node closer to a voltage corresponding to the digital data.

A display device according to the present invention is a display device performing gray-scale display corresponding to image data of n bits (n is an integer not less than 2), including: a current supply circuit for supplying a display current corresponding to the image data; a plurality of pixel circuits each including a current-driven light-emitting device providing a brightness corresponding to a supplied current and a pixel driving circuit for supplying the current-driven light-emitting device with the current corresponding to the display current; and a current data line for conveying the display current, which is provided by the current supply circuit, to the plurality of pixel circuits, where the pixel driving circuit has a current driving device connected between the current data line and a first power supply node during a predetermined period in which the display current is conveyed thereto, and supplies outside the predetermined period the current-driven light-emitting device with a current corresponding to the display current conveyed during the predetermined period, and the current supply circuit includes: a current control circuit provided between a second power supply node and the current data line and receiving the image data for controlling, corresponding to the image data, an amount of current on a current path established including the current data line between the first and second power supply nodes during supply of the display current; and a voltage regulating circuit receiving the image data for forcing a change in voltage on the current data line based on the image data.

A current supply circuit according to the present invention is capable of forcing, from immediately after or before initiation of a current corresponding to digital data, a change in voltage on an output node on which a current corresponding to the digital data is output, such that a current at a desired level can be promptly generated.

More particularly, using such a current supply circuit to generate a gray-scale current for gray-scale display supplied to pixels in a display device provides prompter generation of gray-scale current, thereby improving the display quality of the display device and reducing the power consumption. Moreover, the voltage on the output node reaches a steady state within a short period of time even when the gray-scale current is small and a long time would be required for charging without a precharge circuit, such that the value of current for one gray-level in an image can be reduced, i.e. high-precision gray-scale display is possible even for a larger number of data bits, thereby providing high image quality.

BEST MODES FOR CARRYING OUT THE INVENTION

Embodiments of the present invention are described below in detail with reference to the drawings, in which the same designations indicate the same or corresponding components.

First Embodiment

Figure 1:
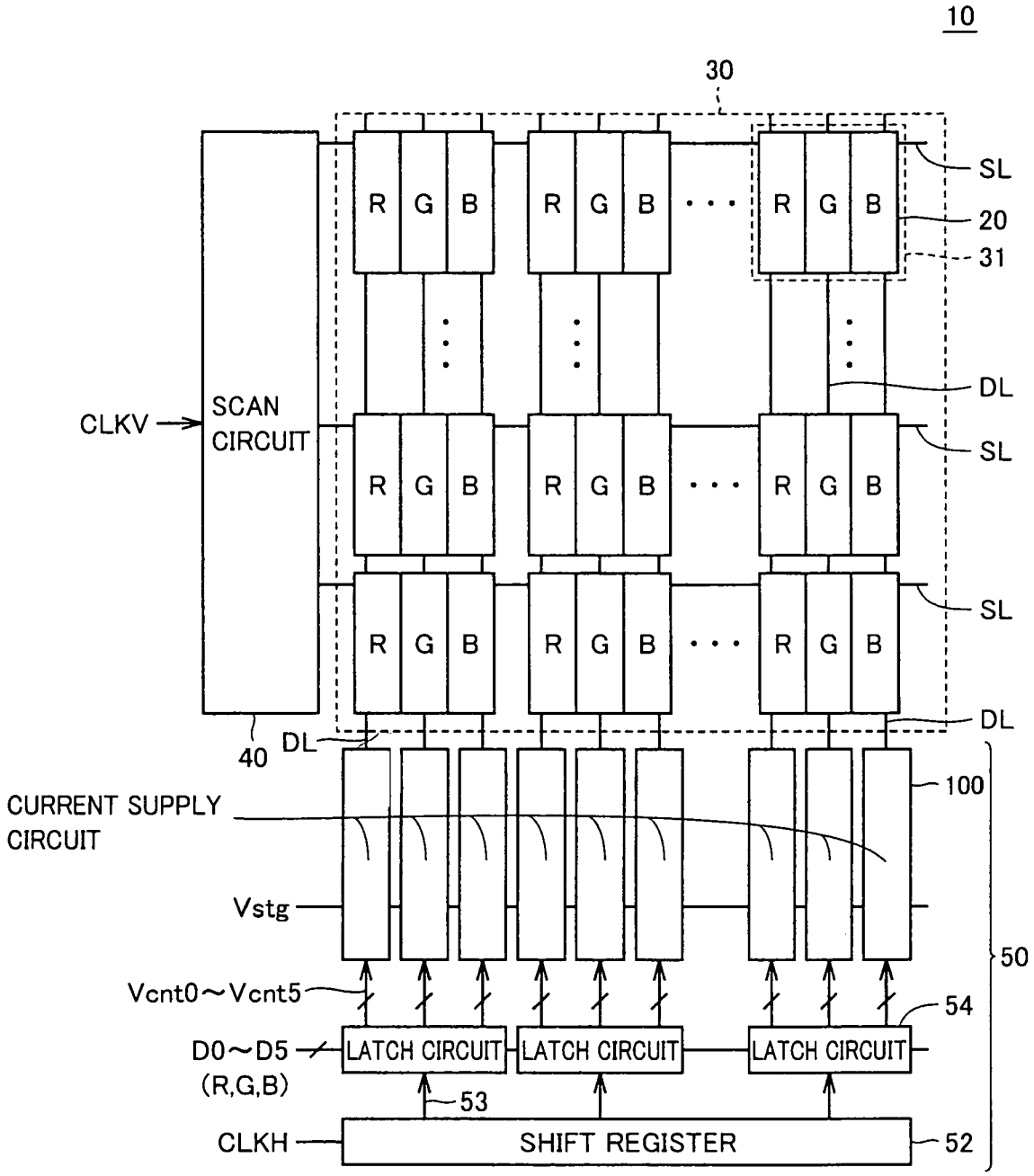
FIG. 1 is a block diagram illustrating the entire configuration of a display device including a current supply circuit according to the present invention.

FIG. 1 is a block diagram illustrating the entire configuration of a display device including a current supply circuit according to the present invention.

Referring to FIG. 1, a display device 10 includes a display panel section 30 having a plurality of pixel circuits 20 arranged in a matrix, a scan circuit 40 and a gray-scale current generator 50.

In the following description, display device 10 produces an image corresponding to six-bit image data composed of data bits D0-D5, which means that each pixel performs, based on six-bit image data, gray-scale display in $2^6$=64 gray-levels.

Each pixel circuit 20 has a current-driven light-emitting device (such as an EL device or light-emitting diode), as described in detail further below. Plurality of pixel circuits 20 in display panel section 30 are arranged in a matrix. A scan line SL is provided for each row of pixels (hereinafter also referred to simply as "pixel row"), while a data line DL is provided for each column of pixels (hereinafter also referred to simply as "pixel column").

In each pixel row, three pixel circuits 20 form one color display unit 31 that is capable of displaying red (R), green (G) and blue (B) using its three pixel circuits 20 to produce a color image.

Scan circuit 40 responds to a clock CLKV indicating a predetermined scan period and successively selects a pixel row. Scan circuit 40 activates a scan line SL corresponding to the selected row to a selected state, while inactivating the remaining scan lines SL to an unselected state. Thus, each scan line SL is sequentially activated to the selected state within a constant period.

Gray-scale current generator 50 includes a shift register 52, a latch circuit 54 and a current supply circuit 100.

Shift register 52 responds to a clock CLKH indicating a predetermined period and generates a group of control signals 53 that include control signals for successively selecting pixel rows and a group of associated timing signals.

Latch circuit 54 responds to a latch signal contained in the group of control signals 53 provided from shift register 52, and captures data bits D0-D5 corresponding to one of red (R), green (G) and blue (B). Further, latch circuit 54 responds to holds data bits D0-D5 to generate control signals Vcnt0-Vcnt5 for controlling the operation of a current supply circuit 100 and holds three pairs of data bits D0-D5 corresponding to red (R), green (G) and blue (B), respectively. Although FIG. 1 illustrates one latch circuit 54 provided for three pixel columns composing one color display unit 31, such a latch circuit may be provided for each pixel column or may be provided for more pixel columns.

Since pixel circuits 20 that each display red (R), green (G) or blue (B) are configured and operated in similar fashion, the configuration and operation of pixels are described in the following description in a general term and without distinguishing them for their displayed colors.

A current supply circuit 100 is provided for each data line DL, and responds to a control signal Vstg defining a time for precharging and to control signals Vcnt0-Vcnt5 from latch circuit 54 to supply a gray-scale current corresponding to data bits D0-D5 to a corresponding data line DL.

In the following description, gray-scale currents corresponding to 64 ($2^6$) gray-levels are indicated as currents I0-I63. The difference between current levels for adjacent gray-levels are equal to each other, i.e., I0=0 and I63−I62=I62−I61= . . . =I3−I2=I2−I1=I1−I0=I1.

Although FIG. 1 illustrates a configuration of a display device in which scan circuit 40 and gray-scale current generator 50 are integrally constructed with display panel section 30, these circuit portions may be external to display panel section 30.

Figure 2:
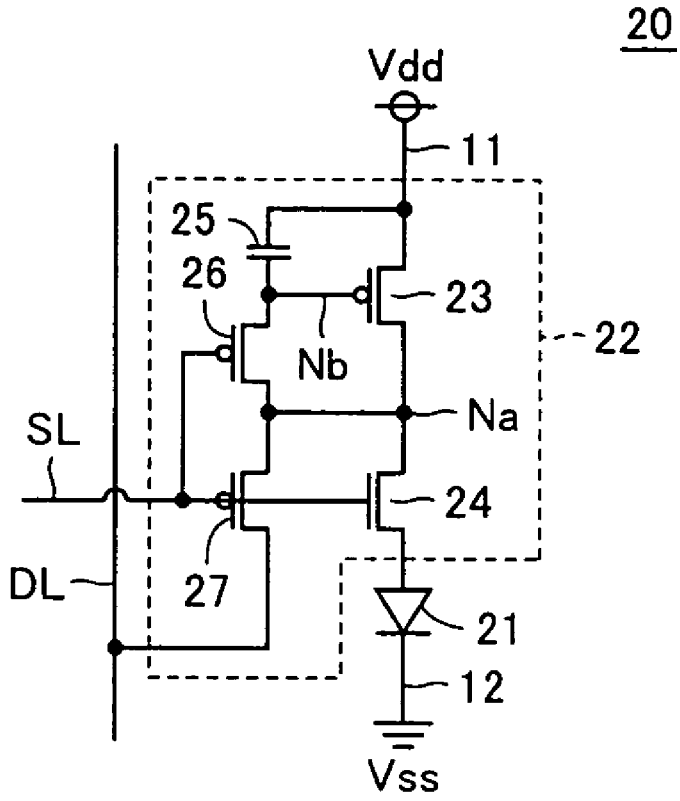
FIG. 2 is a circuit diagram illustrating a configuration of a pixel circuit shown in FIG. 1.

FIG. 2 is a circuit diagram showing a configuration of a pixel circuit 20 shown in FIG. 1. By way of example, FIG. 2 shows a current-programmed pixel circuit configuration with a current-driven light-emitting device including an organic light-emitting diode (OLED).

Referring to FIG. 2, pixel circuit 20 includes an organic light-emitting diode 21 and a pixel driving circuit 22. Pixel driving circuit 22 receives a gray-scale current transferred from a current supply circuit 100 via a data line DL, and supplies organic light-emitting diode 21 with a current corresponding to the transferred gray-scale current. Pixel driving circuit 22 has p-type TFTs 23, 26 and 27, as well as an n-type TFT 24 and a capacitor 25.

The current driving device i.e. p-type TFT 23 has a source connected with a power supply node 11 providing a power supply voltage Vdd, a drain connected with a node Na, and a gate connected with a node Nb. Capacitor 25 is connected between power supply node 11 and node Nb to maintain a source-gate voltage (hereinafter also referred to as "gate voltage") of p-type TFT 23.

P-type TFT 26 serves as a switching device for controlling the connectivity between nodes Na and Nb, while p-type TFT 27 serves as a switching device for controlling the connectivity between data line DL and node Na. N-type TFT 24 serves as a switching device for controlling the connectivity between node Na and organic light-emitting diode 21. N-type TFT 24 and p-type TFTs 26 and 27 each have their gates connected with a corresponding scan line SL.

Organic light-emitting diode 21 is connected between n-type TFT 24 and a power supply node 12 that provides a predetermined voltage Vss (for example a ground voltage), that is, power supply node 12 corresponds to a common electrode. FIG. 2 shows a representative configuration, "cathode common", in which the cathode of organic light-emitting diode 21 is connected with a common electrode. Organic light-emitting diode 21 provides a brightness corresponding to a supplied current.

In the pixel circuit of the present embodiment, the selected state means p-type TFTs 26 and 27 being turned on i.e. scan line SL being at a logical low level (hereinafter referred to simply as "L level") and the unselected state means n-type TFT 24 being turned on i.e. scan line SL being at a logical high level (hereinafter referred to simply as "H level").

In a pixel in which its corresponding scan line SL is set to the selected state (L level), p-type TFTs 26 and 27 are turned on such that a current path is established from power supply node 11 (supply voltage Vdd) through p-type TFTs 23 and 27 and data line DL to current supply circuit 100, and a gray-scale current controlled by current supply circuit 100 is allowed to flow into this current path.

At this moment, current driving circuit 22 establishes connectivity between the drain and gate of the current driving device i.e. p-type TFT 23 by p-type TFT 26 and p-type TFT 23 is diode-connected. Further, a state of the current driving device allowing a gray-scale current to flow, i.e. the gate voltage of p-type TFT 23 is maintained by capacitor 25. Thus, a gray-scale current corresponding to image data is programmed by pixel driving circuit 22 during scan line SL being selected.

Subsequently, when the subject to be scanned is switched and the corresponding scan line SL is set to the unselected state (H level), p-type TFTs 26, 27 are turned off and n-type TFT 24 is turned on. Thus, pixel circuit 20 establishes a current path from power supply node 11 (supply voltage Vdd) through p-type TFT 23, n-type TFT 24 and organic light-emitting diode 21 to power supply node 12 (predetermined voltage Vss), and a current corresponding to the gate voltage in p-type TFT 23 is allowed to flow into the current path. As a result, a gray-scale current programmed while scan line SL was selected can be continuously supplied to organic light-emitting diode 21 even while scan line SL is unselected. In this way, the display brightness for each pixel circuit may be updated corresponding to the selection of a scan line SL and is maintained, even while this scan line SL is unselected, at a level set while the scan line was selected.

Figure 3:
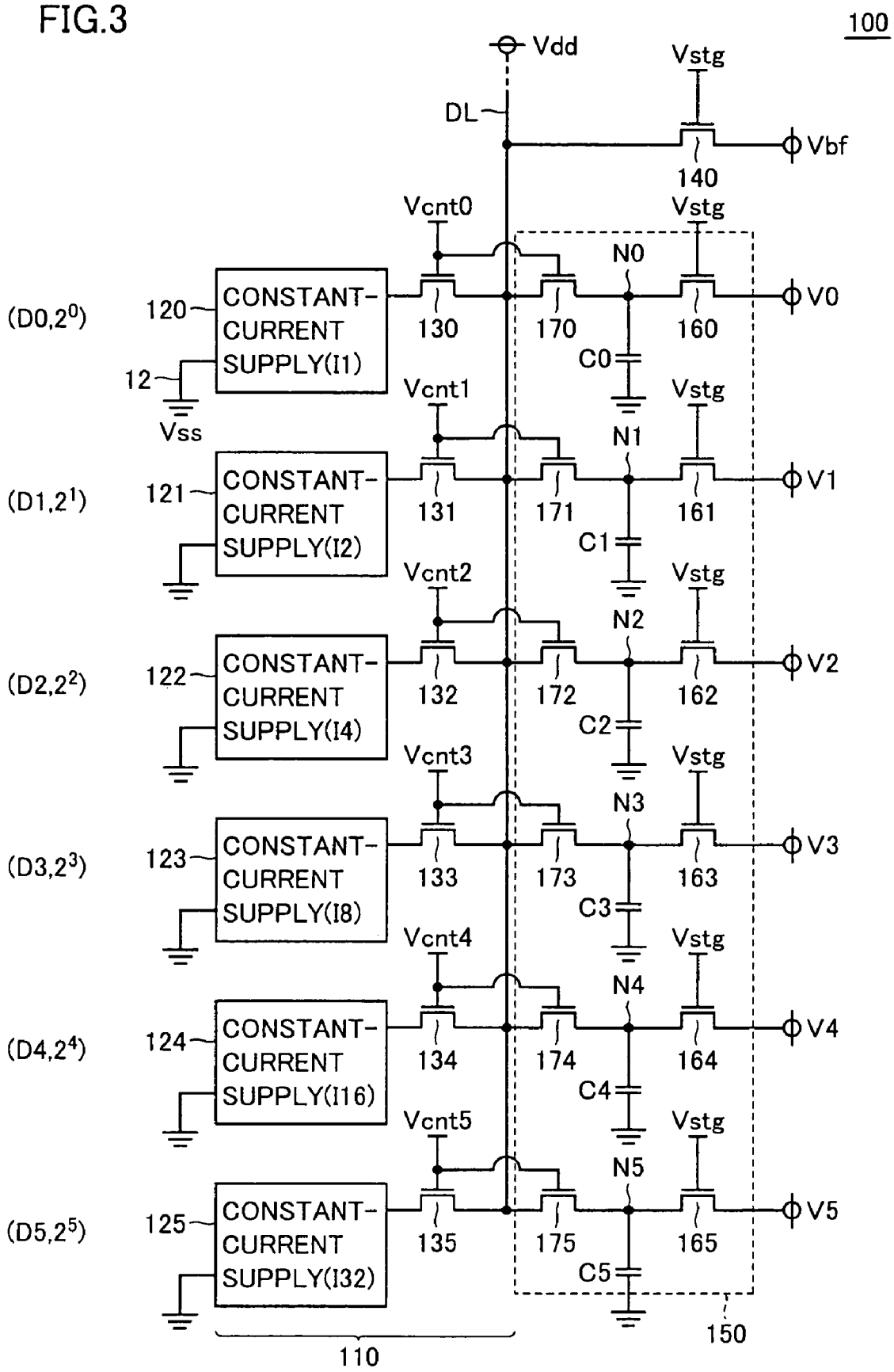
FIG. 3 is a circuit diagram showing a configuration of a current supply circuit according to a first embodiment.

FIG. 3 is a circuit diagram showing a structure of a current supply circuit 100 according to the first embodiment.

Referring to FIG. 3, current supply circuit 100 includes a current control circuit 110, a precharge switch 140 and precharge regulating circuit 150. Current supply circuit 100 supplies a data line DL, which corresponds to a current output node, with a gray-scale current, which is an analog current corresponding to digital data composed of data bits D0-D5.

Current control circuit 110 has constant-current supplies 120-125 and switching devices 130-135 corresponding to respective data bits D0-D5. Switching devices 130-135 are connected in series to constant-current supplies 120-125, respectively, between data line DL and power supply node 12. Although power supply node 12, to which constant-current supplies 120-125 are connected, may not necessarily be identical with the common electrode, it is illustrated as a node supplying the same prescribed voltage Vss as with the common electrode, using the same designation as power supply node 12 in FIG. 2. Alternatively, power supply node 12 shown in FIG. 3 may be substituted with another power supply node providing a voltage other than the prescribed voltage Vss.

Constant-current supplies 120-125 provide constant currents that are weighed corresponding to the least significant bit (LSB) i.e. data bit D0 up to the most significant bit (MSB) i.e. data bit D5, respectively. Specifically, constant-current supply 120 provides a current I1, constant-current supply 121 provides a current I2, constant-current supply 122 provides a current I4, constant-current supply 123 provides a current I8, constant-current supply 124 provides a current I16, and constant-current supply 125 provides a current I32.

Switching devices 130-135 switch on and off in response to respective control signals Vcnt0-Vcnt5. Each of switching devices 130-135 switches on when a corresponding control signal Vcnt (generally designating control signals Vcnt0-Vcnt5) is at H level, and switches off for L level. Control signals Vcnt0-Vcnt5 are set to H level when corresponding data bits D0-D5 are "1" at the time of supply of a gray-scale current, while they are set to L level for "0".

Thus, depending on the combination of data bits D0-D5, a current can flow between power supply node 12 (predetermined voltage Vss) and data line DL electrically connected with power supply node 11 (supply voltage Vdd) in the region of pixel circuit 20 by a constant-current supply with a corresponding data bit of "1", corresponding to data bits D0-D5. That is, gray-scale currents in 64 levels, i.e. currents I0, I1-I63 can be supplied to data line DL corresponding to (D5, D4, D3, D2, D1, D0)=(0, 0, 0, 0, 0, 0)-(1, 1, 1, 1, 1, 1).

The steady voltage Vst on data line DL when a gray-scale current is supplied is determined based on the voltage-current characteristics of a current driving device (p-type TFT 23 in FIG. 2) for the time when the gray-scale current is allowed to flow to data line DL. In other words, when a gray-scale current is supplied, the gray-scale current supplied to data line DL and pixel circuit 20 is not yet settled to a level precisely corresponding to data bits D0-D5 during the transient period i.e. until the voltage on data line DL (hereinafter referred to simply as "data line voltage") settles to a steady voltage Vst corresponding to the gray-scale current.

Prior to supply of the gray-scale current, precharge switch 140 precharges data line DL to a predetermined voltage (precharge voltage) Vbf by switching on in response to control signal Vstg. For example, precharge switch 140 can be constructed by an n-type TFT that is connected between data line DL and a node supplying predetermined voltage Vbf, to receive control signal Vstg at its gate.

Precharge regulating circuit 150 has switching devices 160-165, 170-175 and capacitors C0-C5. Capacitors C0-C5 are connected between nodes N0-N5, respectively, and a predetermined voltage.

Switching devices 160-165 are provided between charging voltages V0-V5 and nodes N0-N5, respectively, each switching on and off in response to control signal Vstg common to themselves and precharge switch 140.

Switching devices 170-175 are provided between nodes N0-N5, respectively, and data line DL and switch on and off in response to control signals Vcnt0-Vcnt5, respectively, common to themselves and switching devices 130-135. Switching devices 160-165, 170-175 each may be constructed by an n-type TFT, as a representative example.

Thus, switching devices 160 and 170 and capacitor C0 form a precharge regulating unit for data bit D0. Similarly, switching devices 161-165 and 171-175 and capacitors C1-C5 form precharge regulating units for data bits D1-D5, respectively.

Figure 4:
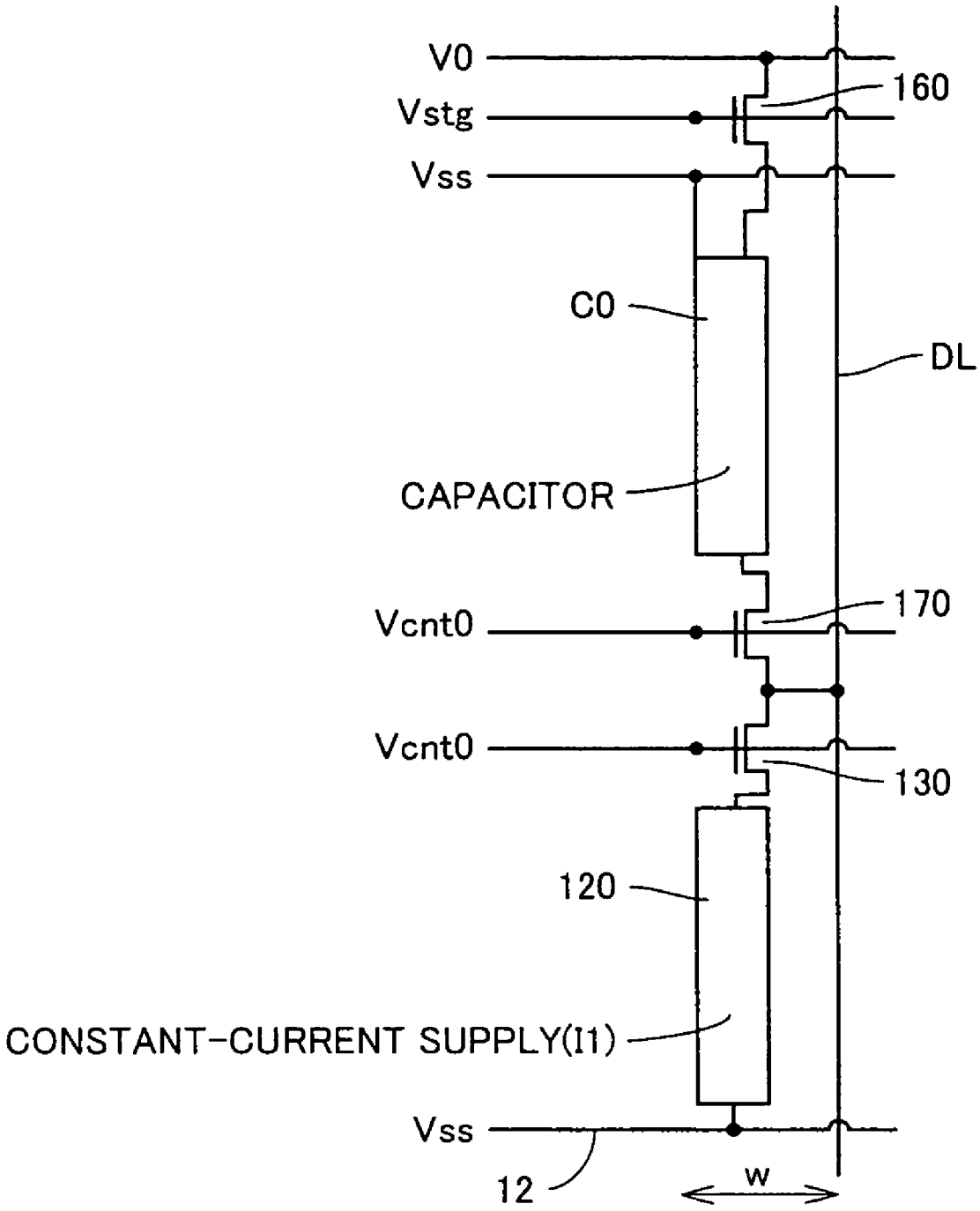
FIG. 4 is a circuit diagram showing a particular arrangement of the elements in a current supply circuit according to the first embodiment.

FIG. 4 illustrates a particular arrangement of the elements in the current control circuit and a precharge regulating circuit shown in FIG. 3, represented by a circuit portion for data bit D0.

Referring to FIG. 4, all of switching devices 130, 160 and 170 are constructed by n-type TFTs, although they may be constructed by either n-type or p-type TFTs. Specifically, the conductivity types of TFT devices used for switching devices 130, 160 and 170 may be combined as: (device 130, device 160, device 170)=(p-type, p-type, p-type), (n-type, p-type, n-type) or (p-type, n-type, p-type).

The arrangement of the elements in the current control circuit and the precharge regulating circuit illustrated in FIG. 4 also applies to the circuit portions for other data bits than D0.

Since current supply circuit 100 is disposed for each data line DL, the disposition of the circuitry generally causes more difficulty as the resolution of the display device is increased and the width of each column in the display device is decreased. In the arrangement of the elements shown in FIG. 4, however, constant-current supply 120, capacitor C0 and switching devices 130, 160, 170 for the common data bit (D0) are aligned in the direction along the columns, and the current conduction direction for switching devices 130, 160, 170 is parallel to data line DL, thereby decreasing the circuit width W, which is advantageous in the integration of circuitry.

The operation of current supply circuit 100 is now described with reference to FIG. 5.

Figure 5:
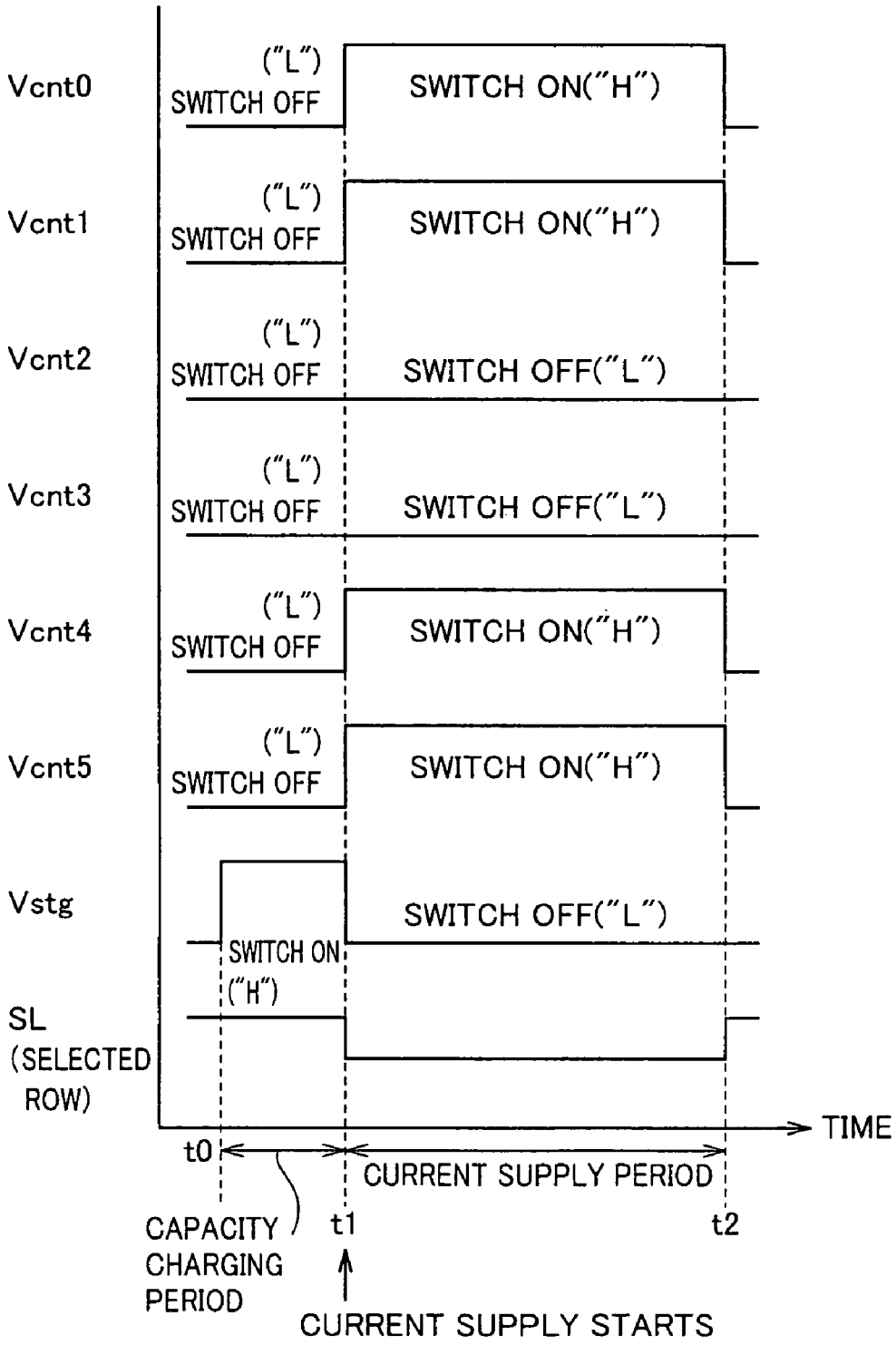
FIG. 5 is a waveform diagram illustrating the operation of a current supply circuit according to the first embodiment.

Referring to FIG. 5, prior to time t1 at which the current supply period begins, control signals Vcnt0-Vcnt5 are set to L level without regard to the level of data bits D0-D5.

Further, during the capacity charging period (between times t0 and t1) which precedes the current supply period, control signal Vstg is set to H level and switching devices 140, 160-165 are turned on. Thus, during the capacity charging period, data line DL is charged to predetermined voltage Vbf while capacitors C0-C5 are charged by charging voltages V0-V5, respectively.

At time t1, the scan line SL of a selected row changes from the unselected state (H level) to the selected state (L level) to provide current to the selected row's pixels. The scan line SL is maintained at the selected state until time t2, at which the subject to be scanned is switched.

When the scan line SL of the selected row is set to the selected state, data line DL is electrically connected to power supply node 11 (supply voltage Vdd) by the pixel circuit 20 of the selected row via the current driving device (p-type TFT 23), as described above.

During the current supply period (between times t1 and t2), control signals Vcnt0-Vcnt5 are set based on data bits D0-D5, respectively, to corresponding levels. FIG. 5 illustrates data bits D0-D5 as: (D5, D4, D3, D2, D1, D0)=(1, 1, 0, 0, 1, 1).

Thus, switching devices 130, 131, 134 and 135 with a corresponding data bit of "1" are turned on to connect constant-current supplies 120, 121, 124, 125 with data line DL. Accordingly, the current along data line DL, that is, the gray-scale current supplied by current supply circuit 100, is set to the sum of supply currents from constant-current supplies 120, 121, 124 and 125 i.e. I1+I2+I16+I32=I51.

To reach a steady state, the data line voltage comes to settle at a steady voltage, which corresponds to the current I51, and when the data line voltage reaches the steady voltage, the gray-scale current along data line DL also settles at the current I51, which corresponds to image data. The steady voltage on data line DL varies depending on data bits D0-D5. The level of the steady voltage can be uniquely determined in advance by the level of the gray-scale current determined based on data bits D0-D5, and the characteristics of the current driving devices.

In response to control signals Vcnt0-Vcnt5, switching devices 130, 131, 134 and 135 as well as switching devices 170, 171, 174 and 175 switch on. Accordingly, from the beginning of the current supply period onward, data line DL is connected to capacitors C0, C1, C4, C5 with a corresponding data bit of "1". Thus, while the current supply is performed as described above, charge is exchanged between data line DL and capacitors C0, C1, C4, C5.

In precharge regulating circuit 150, the connectivity between data line DL and capacitors C0-C5 is regulated depending on data bits D0-D5 such that precharge regulating circuit 150 is capable of forcing a change in voltage on data line DL corresponding to data bits D0-D5. As detailed below, precharge regulating circuit 150 is configured such that the exchange of electric charge between precharge regulating circuit 150 and data line DL moves the data line voltage closer to a steady voltage for data line DL corresponding to data bits D0-D5.

Figure 6:
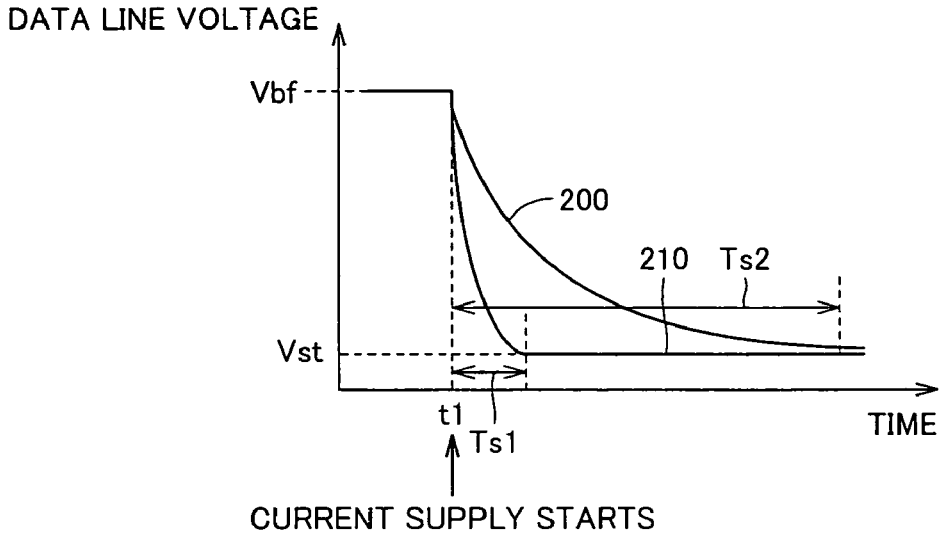
FIG. 6 is a schematic diagram illustrating the progression of a data line voltage during supply of current by a current supply circuit according to the first embodiment.

FIG. 6 is a schematic diagram illustrating the progression of a data line voltage during current supply by a current supply circuit according to the first embodiment.

In FIG. 6, the progression of a data line voltage during current supply by current supply circuit 100 according to the present invention is designated by the numeral 200. For comparison, numeral 210 designates the progression of data line voltage where data line DL is precharged to a predetermined voltage before a gray-scale current is supplied without precharge regulating circuit 150 in current supply circuit 100.

Referring to FIG. 6, immediately after the current supply begins at time t1, current supply circuit 100 of the present invention performs the exchange of charge depending on data bits D0-D5 between data line DL and precharge regulating circuit 150 to force the data line voltage from the precharge voltage closer to the steady voltage Vst. In this way, after a lapse from time t1 to settling time Ts1, the data line voltage reaches the steady voltage Vst, after which an accurate gray-scale current can be provided to data line DL.

In the contrary, the arrangement without a precharge regulating circuit 150 allows the data line voltage to come closer to the steady voltage Vst only by virtue of the discharge performed by the constant-current supply connected to data line DL corresponding to data bits D0-D5. In this case, the settling time Ts2 is longer than the settling time Ts1 for current supply circuit 100.

Thus, current supply circuit 100 of the present invention can promptly generate an analog current at a level corresponding to digital data. Using such a current supply circuit to generate a gray-scale current supplied to each pixel for gray-scale display, provides prompter generation of gray-scale current and improved display quality for a display device as well as reduced power consumption.

Moreover, the data line voltage reaches a steady state within a short period of time even when the gray-scale current is small and a long time would be required for charging without a precharge circuit, such that the value of current for one gray-level in an image can be reduced, i.e. high-precision gray-scale display is possible even for a larger number of data bits, thereby providing high image quality.

Now, a design of the predetermined voltages Vbf, V0-V5 and the capacitances of capacitors C0-C5, which determine the characteristics of precharge regulating circuit 150, will be described in detail.

During the current supply period i.e. the writing of current to the pixel circuit, p-type TFT 23 (current driving device) within pixel circuit 20 passes a gray-scale current while diode-connected. The drain current Id of a p-type transistor with its gate and drain connected with each other and its source connected to supply voltage Vdd is represented as a function of drain voltage Vd as in the following equation (1). In equation (1), the drain current Id [Vd] indicates a drain current Id for the drain voltage Vd.

$$Id[Vd]=(\beta/2)\cdot(Vdd-Vd-Vth)^2 \quad (1)$$

Where $\beta=(\mu\cdot W\cdot Cox)/L$, $\beta$ is the current coefficient, $\mu$ is the average mobility, W is the gate channel width, Cox is the gate capacity (per unit area), L is the gate channel length, and Vth is the threshold voltage.

In the case that the current driving device is an n-type transistor with its source connected with the ground voltage (0V), equation (1) may be substituted with the following equation (2) to determine the drain current:

$$Id[Vd]=(\beta/2)\cdot(Vd-Vth)^2 \quad (2)$$

Accordingly, from either equation (1) or (2), the drain voltage Vd or the steady voltage on data line DL can be uniquely determined depending on the level of the drain current Id or gray-scale current.

The conditions under which precharge regulating circuit 150 performs the optimal exchange of charge can be determined by solving a conservation of charge while taking this steady voltage Vst into consideration. That is, the predetermined voltages Vbf, V0 through V5 and the capacitances of capacitors C0-C5 can be determined by solving a conservation of charge between before and after switching devices 170-175 switch on, while taking the steady voltage on the data line into consideration.

Suppose that the data line voltage after switching devices 170-175 switch on in response to data bits D0-D5 i.e. after precharge regulating circuit 150 is operated is Vaf, then a conservation of charge between precharge regulating circuit 150 and data line DL established before and after switching devices 170-175 switch on is represented by the following equation (3). It should be noted that the capacitances of capacitors C0-C5 are also referred to as C0-C5 in the following description.

$$(Csg+\Sigma Ck)\cdot Vaf=Csg\cdot Vbf+\Sigma(Ck\cdot Vk) \quad (3)$$

Here, Csg is the data line capacity and k is a k when Dk="1" for k=0 to 5.

To promptly settle the gray-scale current, voltage Vaf is desirably the same as a steady voltage Vst determined in the above equation (1) or (2). Accordingly, equation (3) where the steady voltage Vst is assigned to Vaf for the 64 combinations of data bits D0-D5 may be solved as simultaneous equations to determine the voltages Vbf, V0-V5 and capacitances C0-C5.

It was assumed here that, as one exemplary design, Csg=2 pF (picofarad), V5=1V and the supply voltage Vdd=8.5V, the current coefficient $(\beta/2)=1.9\times10^{-7}$ (also referred to as 1.9E−7).

Since there are twelve unknowns, equations (4) through (15) may be solved as simultaneous equations to determine representative 12 out of 64 combinations.

It should be noted that, in equations (4) through (15), voltage Vd[Id=x] indicates the drain voltage Vd (i.e. steady voltage Vst) for the drain current (gray-scale current) Id=x. Voltage Vd[Id=x] may be determined by the above equation (1).

$$(2+C5)\times Vd[Id=I32]=2\times Vbf+C5\times V5 \quad (4)$$

$$(2+C4)\times Vd[Id=I16]=2\times Vbf+C4\times V4 \quad (5)$$

$$(2+C3)\times Vd[Id=I8]=2\times Vbf+C3\times V3 \quad (6)$$

$$(2+C2)\times Vd[Id=I4]=2\times Vbf+C2\times V2 \quad (7)$$

$$(2+C1)\times Vd[Id=I2]=2\times Vbf+C1\times V1 \quad (8)$$

$$(2+C0)\times Vd[Id=I1]=2\times Vbf+C0\times V0 \quad (9)$$

$$(2+C5+C4)\times Vd[Id=I48]=2\times Vbf+C5\times V5+C4\times V4 \quad (10)$$

$$(2+C4+C3)\times Vd[Id=I24]=2\times Vbf+C4\times V4+C3\times V3 \quad (11)$$

$$(2+C3+C2)\times Vd[Id=I12]=2\times Vbf+C3\times V3+C2\times V2 \quad (12)$$

$$(2+C2+C1)\times Vd[Id=I6]=2\times Vbf+C2\times V2+C1\times V1 \quad (13)$$

$$(2+C1+C0)\times Vd[Id=I3]=2\times Vbf+C1\times V1+C0\times V0 \quad (14)$$

$$(2+C0+C5)\times Vd[Id=I33]=2\times Vbf+C0\times V0+C5\times V5 \quad (15)$$

For example, if I32=1.0E−6 (1.0 μA is a microampere), equations (4) through (15) may be solved as simultaneous equations to provide the following results:

$$Vbf=5.27V,\ V0=1.96V,\ V1=3.54V,\ V2=2.89V,\ V3=2.57V,$$

$$V4=-0.29V,\ (V5=1.0V).$$

Further,

C0=0.11 pF, C1=0.50 pF, C2=0.65 pF, C3=1.03 pF, C4=0.67 pF, C5=1.87 pF.

Figure 7:
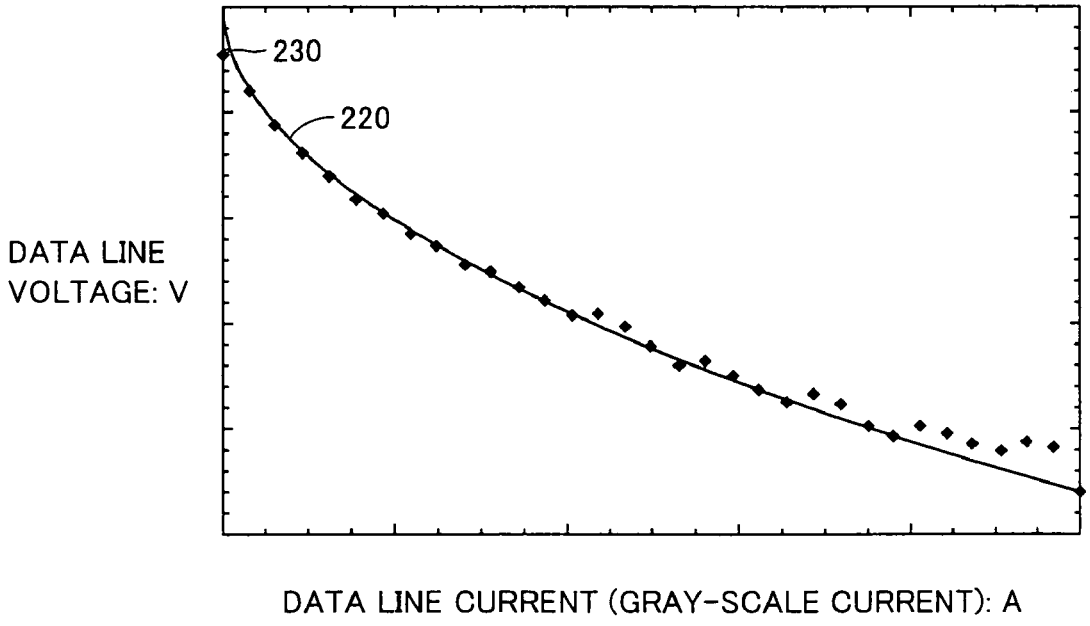
FIG. 7 is a schematic diagram illustrating the effects achieved by a precharge regulating circuit in a current supply circuit according to the present invention.

FIG. 7 is a schematic diagram illustrating the effects achieved by a precharge regulating circuit in a current supply circuit according to the present invention.

Referring to FIG. 7, the horizontal axis indicates the current on data line DL i.e. gray-scale current, while the vertical axis indicates the data line voltage. A characteristic line 220 indicates the relation between the drain voltage (data line voltage) and the drain current (data line current i.e. gray-scale current) of a current driving device (p-type TFT 23) in a pixel circuit indicated by the above equation (1).

Further, for each of the gray-scale current levels that are set as gray-levels corresponding to data bits D0-D5, capacitances C0-C5 as well as voltages Vbf, V0-V5 determined above are used to determine the voltage Vaf corresponding to each gray-scale current using the above equation (3), as indicated by characteristic dots 230. That is, the data line voltages indicated by characteristic dots 230 correspond to the voltages achieved by the exchange of charge by precharge regulating circuit 150.

As understood from comparison between characteristic line 220 and the plotted characteristic dots 230, a precharge regulating circuit 150 designed as above is capable of promptly moving the data line voltage closer to a steady voltage after current supply starts. As a result, as explained with reference to FIG. 6, a gray-scale current at a level corresponding to data bits D0-D5 can be promptly produced on data line DL.

Second Embodiment

Figure 8:
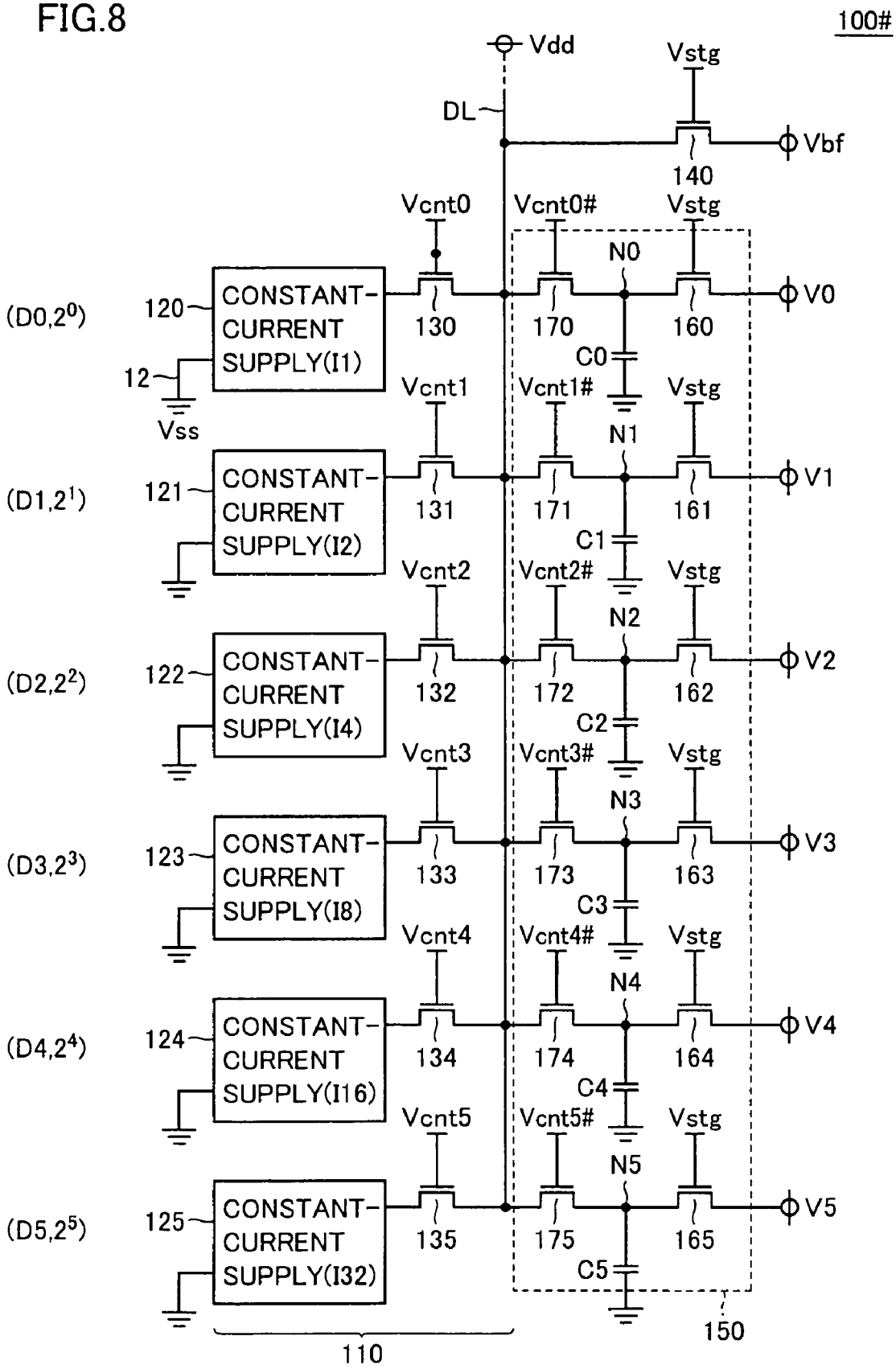
FIG. 8 is a circuit diagram showing a configuration of a current supply circuit according to a second embodiment.

FIG. 8 is a circuit diagram showing a configuration of a current supply circuit according to a second embodiment.

As will be apparent from the following description, current supply circuit 100# according to the second embodiment is different from current supply circuit 100 according to the first embodiment in the timing of operation of precharge regulating circuit 150, but similar to current supply circuit 100 in the configuration of the other parts and the basic operation. Accordingly, current supply circuit 100 in the configuration shown in FIG. 1 may be substituted with current supply circuit 100# of FIG. 8 to construct a display device having similar effects.

Referring to FIG. 8, current supply circuit 100# according to the second embodiment is different from current supply circuit 100 according to the first embodiment shown in FIG. 3 in that control signals Vcnt0#-Vcnt5# controlling the on-and off-states of switching devices 170-175 are independently set from control signals Vcnt0-Vcnt5 controlling the on- and off-states of switching devices 130-135. The configuration of the other parts is similar to that in current supply circuit 100 shown in FIG. 3 and, therefore, is not described in detail again.

Figure 9:
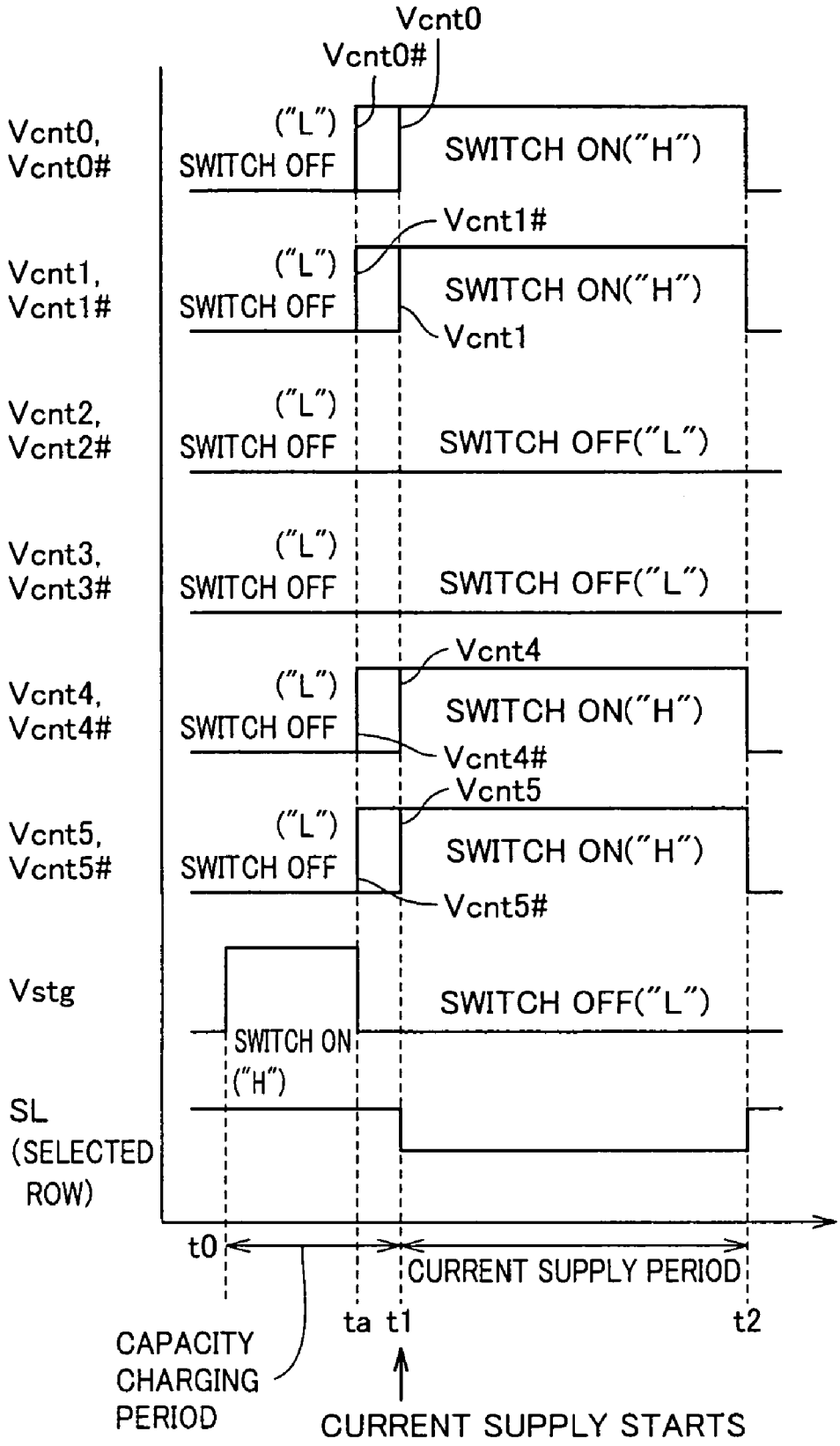
FIG. 9 is a waveform diagram illustrating the operation of a current supply circuit according to the second embodiment.

FIG. 9 is a waveform diagram illustrating the operation of a current supply circuit according to the second embodiment.

Referring to FIG. 9, in current supply circuit 100# according to the second embodiment, control signals Vcnt0-Vcnt5, similar to those shown in FIG. 5, are set to L level until time t1 at which current supply starts, and are set to levels corresponding to respective data bits D0-D5 during the current supply period. The capacity charging period is completed at time ta, prior to time t1.

Accordingly, control signal Vstg is set to H level between times t0 and ta, and is set to L level after time ta. As a result, at time ta, precharge switch 140 is turned off while switching devices 160-165 for charging the capacitors are also turned off.

From time ta onward, control signals Vcnt0#-Vcnt5# are set to levels corresponding to data bits D0-D5, which levels are maintained until time t2. That is, control signals Vcnt0#-Vcnt5# are set to the same levels as for control signals Vcnt0-Vcnt5 earlier than control signals Vcnt0-Vcnt5.

As a result, in times ta-t1 i.e. before current supply is started at time t1, the data line voltage can be moved in advance closer to a steady voltage for the supply of gray-scale currents corresponding to data bits D0-D5. Current supply is then started, thereby allowing prompt generation of gray-scale current in the arrangement according to the second embodiment similar to the current supply circuit according to the first embodiment.

Control signals Vstg, Vcnt0-Vcnt5, Vcnt0#-Vcnt5# illustrated in the first and second embodiments may be provided by generating a group of control signals 53 i.e. timing signals corresponding to clock CLKH, which is used to successively select pixel columns, delayed by shift register 52 as appropriate, and performing logical operation on data bits D0-D5 and the group of control signals 53 in latch circuit 54.

In the above description, an arrangement of the present invention has been described in which each pixel performs gray-scale display corresponding to six-bit digital data composed of data bits D0-D5. However, the number of bits in digital data is not limited thereto and the number of constant-current supplies 120-125 contained in a constant-current circuit and the number of charging capacitors C0-C5 in precharge regulating circuit 150 can be provided depending on the number of bits such that the current supply circuit of the present invention can be applied for a desired number of bits.

Moreover, the arrangement of pixels shown in FIG. 2 is a representative example only, and the present invention can be applied to a display device including a pixel containing a pixel driving circuit in a desired arrangement including a current driving device electrically connected to data line DL for passing a gray-scale current during the period of writing with current, and a current-driven light-emitting device.

The embodiments disclosed herein should be considered to be by way of example only and not by way of limitation. The scope of the present invention is set forth in the claims rather than the above description, and intends to include all the modifications within the spirit and scope equivalent to those defined in the claims.

INDUSTRIAL APPLICABILITY

The present invention is suitable for various devices including a circuit that supplies a current corresponding to digital data, such as a self-emitting display device having pixels constructed by current-driven light-emitting devices.

The invention claimed is:

1. A current supply circuit providing an output current corresponding to digital data of n bits (wherein n is an integer not less than 2), comprising:

a current driving device;

a current output node electrically connected to a first power supply node via said current driving device while current is being supplied by said current supply circuit;

a current control circuit connected between a second power supply node and said current output node, receiving digital data, corresponding to the digital data, for controlling the current flowing in a current path, that includes said current output node and extends between the first and second power supply nodes, while current is being supplied by said current supply circuit; and a voltage regulating circuit receiving the digital data for forcing, after the current supplying starts, a change in voltage on said current output node, based on the digital data, said voltage regulating circuit including a plurality of internal nodes corresponding to respective bits of the digital data, a plurality of voltage sources corresponding to respective internal nodes, each voltage source independently supplying a respective voltage, a plurality of first switch elements respectively connected between respective voltage sources and internal nodes, a plurality of capacitors connected to respective internal nodes, and a plurality of second switch elements connected between said current output node and respective internal nodes, wherein each of said second switch elements turns on or off depending upon a corresponding bit of the digital data while current is being supplied by said current supply circuit.

2. The current supply circuit according to claim 1, wherein said current driving device includes a field effect transistor having a source and a drain electrically connected to said first power supply node and said current output node, respectively, and a gate, and the gate and drain of said field effect transistor are electrically connected to each other while current is being supplied by said current supply circuit.

3. The current supply circuit according to claim 1, wherein, while current is being supplied by said current supply circuit, the voltage on said current output node settles to a steady voltage corresponding to a level of the output current, depending on characteristics of said current driving device, and said voltage regulating circuit exchanges electrical charge with said current output node to move the voltage on said current output node closer to the steady voltage corresponding to the digital data.

4. The current supply circuit according to claim 1, wherein said current control circuit includes n constant-current supplies respectively corresponding to the n bits of the digital data and connected in parallel to said current output node, and said n constant-current supplies generate, respectively corresponding to the n bits, first to n-th currents between the second power supply node and said current output node.

5. The current supply circuit according to claim 4, wherein the first to n-th currents are set in gradations in a power of 2 corresponding to a predetermined weighting of the n bits of the digital data.

6. A display device producing a gray-scale display corresponding to image data of n bits (wherein n is an integer not less than 2), comprising:

a current supply circuit for supplying a display current corresponding to the image data;

a plurality of pixel circuits, each pixel circuit including a current-driven light-emitting device providing a brightness corresponding to a supplied current and a pixel driving circuit for supplying said current-driven light-emitting device with a current corresponding to the display current; and a current data line for conveying the display current, supplied by said current supply circuit, to said plurality of pixel circuits, wherein said pixel driving circuit has a current driving device connected between said current data line and a first power supply node during a period in which the display current is conveyed to said pixel driving circuit, and supplying said current-driven light-emitting device with the current corresponding to the display current during the period, and said current supply circuit includes:

a current control circuit connected between a second power supply node and said current data line, receiving the image data,and controlling, in correspondence with the image data, the current flowing in a current path, that includes said current data line, and extends between said first and second power supply nodes, while the display current is being supplied by said current supply circuit; and a voltage regulating circuit receiving the image data for forcing, after supplying of the display current starts, a change in voltage on said current data line, based on the image data, said voltage regulating circuit including a plurality of internal nodes corresponding to respective bits of the image data, a plurality of voltage sources corresponding to respective internal nodes, each voltage source independently supplying a respective voltage, a plurality of first switch elements respectively connected between respective voltage sources and internal nodes, a plurality of capacitors connected to respective internal nodes and a plurality of second switch elements connected between said current output node and respective internal nodes, wherein each of said first switch elements turns on prior to supplying of the display current and turns off while the display current is being supplied, and each of said second switch elements turns off in a period during which each of said first switch elements is turned on, and turns on or off depending on a corresponding bit of the image data while the display current is being supplied.

7. The display device according to claim 6, wherein said current control circuit includes n constant-current supplies respectively corresponding to the n bits of the image data and connected in parallel to said current data line, and said n constant-current supplies generate first to n-th currents on said current data line based on the n bits.

8. The current supply circuit according to claim 1, wherein each of said first switch elements turns on prior to a supply period supplying the output current, and each of said second switch elements turns off in a period during which each of said first switch elements turns on.

9. The current supply circuit according to claim 1, wherein said plurality of capacitors, said plurality of internal nodes, said plurality of voltage sources, said plurality of first switch elements, and said plurality of second switch elements are n capacitors, n internal nodes, n voltages sources, n first switch elements, and n second switch elements, respectively, corresponding to n bits of the digital data.

10. The current supply circuit according to claim 9, wherein, while current is being supplied by said current supply circuit, the voltage on said current output node settles to a constant voltage corresponding to a level of the output current depending on characteristics of said current driving device, and the first to n-th voltages respectively supplied from said n voltage sources and capacitances of said n capacitors are designed, for each of at least one of the combinations of the n bits of the digital data, based on conservation of charge, to produce reflects a constant voltage before and after at least one of said n switching devices, corresponding to one of the n bits, is turned on.

* * * * *